US006246329B1

(12) United States Patent
King et al.

(10) Patent No.: US 6,246,329 B1
(45) Date of Patent: Jun. 12, 2001

(54) WATER-PRESSURE SENSITIVE DYE RELEASE LIFE SAVING APPARATUS

(76) Inventors: Lawrence P. King, 8 Edgewood Ct., Colts Neck, NJ (US) 07722; Matthew G. Reinhart, 16 Nancy Ct., Jackson, NJ (US) 08527

( * ) Notice: Subject to any disclaimer, the term of this patent is extended or adjusted under 35 U.S.C. 154(b) by 0 days.

(21) Appl. No.: 09/613,364

(22) Filed: Jul. 10, 2000

(51) Int. Cl.[7] ..... G08B 23/00

(52) U.S. Cl. ..... 340/573.1; 340/573.6; 340/604; 116/211

(58) Field of Search ..... 340/573.1, 573.6, 340/604; 102/334, 341; 149/116; 116/211, 173, 209, 210, 26; 441/89

(56) References Cited

U.S. PATENT DOCUMENTS 3,768,436 * 10/1973 Martini ..... 116/124 B
3,798,629 * 3/1974 La Taillade ..... 340/573
3,960,087 * 6/1976 Beatty ..... 102/90
4,079,364 * 3/1978 Antenore ..... 340/573
4,305,143 * 12/1981 Simms ..... 376/134
4,335,656 * 6/1982 Beatty ..... 102/340
5,029,293 * 7/1991 Fontanille ..... 340/573
5,408,222 * 4/1995 Yaffe ..... 340/604

* cited by examiner

*Primary Examiner*—Daniel J. Wu
*Assistant Examiner*—Anh La
(74) *Attorney, Agent, or Firm*—Charles I. Brodsky

(57) ABSTRACT

A swimmer's safety device including a housing having a source of battery power, a water pressure sensitive switch, a timer and a solenoid valve electronically connected with a circuit board within the housing, arranged to allow a mix of water reactive chemical once the housing is submerged to a depth predetermined aforehand, and for a time interval set in accordance with the skill of the swimmer as well. The housing, in accordance with the invention, could be incorporated as part of a swimsuit construction, can be temporarily secured to the swimsuit of a wearer, or could be worn as a swimsuit accessory such as a wristband, armband, headband or necklace, to, in each instance, permit the water reactive chemical to open a valve in a chamber to release a dye into the surrounding water as a visual alarm alert of a swimmer in need of help.

9 Claims, 2 Drawing Sheets

WATER-PRESSURE SENSITIVE DYE RELEASE LIFE SAVING APPARATUS

FIELD OF THE INVENTION

This invention relates to swimmer's safety devices, in general, and to such a device for providing an alarm alert when a swimmer or other user is submerged in a body of water, in particular.

BACKGROUND OF THE INVENTION

As is known, lifeguards or other security personnel at community swimming pools and water parks are not always able to spot a swimmer in difficulty, especially when the swim facility is well populated. Similarly, at beaches, the lifeguards on duty may not be able to spot a swimmer (or a surfer, for that matter) in distress where the beach is crowded. Oftentimes, the body of a swimmer at the community pool or at the water park is not discovered until minutes, or even hours later lying near the bottom, when the pool is being drained or otherwise cleaned. Frequently, the body of the swimmer or surfer at the beach is not found until it is washed ashore at a later time.

As will be understood, not every drowning person using these facilities can be saved. However, by being able to quickly retrieve a submerging person, the chance of resuscitating and/or reviving the drowning person is greatly enhanced. In accordance with this recognition, it will therefore become apparent that a need exists to enable the submerged swimmer or surfer to be quickly and easily spotted so that appropriate life-saving routines can be carried out.

SUMMARY OF THE INVENTION

As will become clear from the following description, the present invention proceeds upon the realization that people of different age, and of different skill abilities are often under water for differing periods of time, in accordance with their swim activities. Thus, an accomplished swimmer may free-dive without breathing apparatus to a depth far beyond that to which an average swimmer might try to go in just picking something up from the bottom of a pool, or from a lake or ocean-bed for example. In like manner, an average adult swimmer most probably could hold his/her breath under water for a longer period of time than can a child. A novice swimmer—or one who does not know how to swim, or is a toddler, on the other hand—would probably not be able to hold its breath for any period of time, when submerged at any depth. Recognizing the existence of these differences in age and/or ability, the present invention proceeds as a swimmer's safety device, in the nature of a water-pressure sensitive dye release apparatus to provide a visual alarm alert to a lifeguard, to other security personnel, and to anyone in the immediate area that a person has submerged in a body of water, to a given depth, and for a certain period of time.

In particular, and in accordance with a preferred embodiment of the invention, the swimmer's safety device includes a housing having a removable lid enclosing its bottom and side surfaces and the various components maintained inside. A circuit board is included within the housing, electronically coupled with a source of battery power, a water pressure sensitive switch, a timer controlled by the switch, and a solenoid valve controlled by the timer. A chamber is further included within the housing—preferably as a snap-in unit—encasing a dye material with a water reactive chemical, and having a quiescently closed input valve controlled by the solenoid valve. An output valve releases to the water surround.

The swimmer's safety device additionally includes a water inlet valve for the water pressure sensitive switch, with the water pressure sensitive switch being normally open until submerged in the body of water beyond a predetermined depth. In accordance with the invention, such submersion initiates the running of the timer by the water pressure sensitive switch, to, in turn, actuate the solenoid valve to open the inlet valve of the chamber to water. With the chamber output valve being pressure regulated to then release the dye material into the water surround as a visual alarm alert (in response to the reaction of the chemical within with the water being let into the chamber), a dye alert is presented in accordance with the depth to which the housing is submerged into the water.

With the housing incorporated, for example, in a swimsuit construction, or when it is temporarily secured to the swimsuit of a wearer, or even when the housing is just worn as a separate swimsuit accessory as a necklace, bracelet or armband, the swimmer's safety device of the invention can be easily worn.

As will also be seen, the timer selected is one whose running is interrupted upon the subsequent rising of the housing above the predetermined depth, being automatically reset to zero, as well as being reset to zero after a running of the time sequence has been completed. In similarly determining the selection of the water pressure sensitive switch, control can be had as to the point at which the timing sequence initiates, so as to establish both the length of time that the housing needs to be submerged as well as to the depth of submersion, before a visual alert can be given by the releasing dye.

In these manners, the swimmer's safety device could be incorporated in the swimsuit construction, or as a clothing clip-on to the swimsuit, in providing a visual alert just a matter of seconds after a novice or non-swimmer should happen to fall into a body of water of only nominal depth—whereas, for an average or accomplished swimmer, the visual alert would not be provided until the casing is submerged to a greater depth, and/or maintained there for a longer period of time. So, for example, for a swimmer of average ability, the water pressure sensitive switch of the invention may be selected so as to begin initiation of the timer running once a depth of 40 inches is reached, and for a timing sequence of some 30 seconds to be completed before the solenoid valve is actuated to begin to allow water to enter the chamber in reacting with the chemical there to provide the pressure operatively required to release the dye through the chamber's output valve into the body of the water surround. With non-swimmers, or with swimmers of lesser abilities, on the other hand, the water pressure sensitive switch as well as the length of the timing sequence may be selected appropriately, as circumstances dictate.

By thus selecting the depths to be reached before action commences, and the length of time by which submersion to that depth must continue for the dye release to take place, visual indications can be had that a swimmer or surfer has submerged to a depth and/or for a given time as prescribed for that person based upon his/her age and/or swim ability. In this preferred embodiment of the invention, the output valve for the dye releasing material chamber is selected to include a normally closed ball valve which operates to open upon a predetermined pressure build up within the chamber due to the reaction between the water being let in by the solenoid valve and the water reactive chemical included within the chamber.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
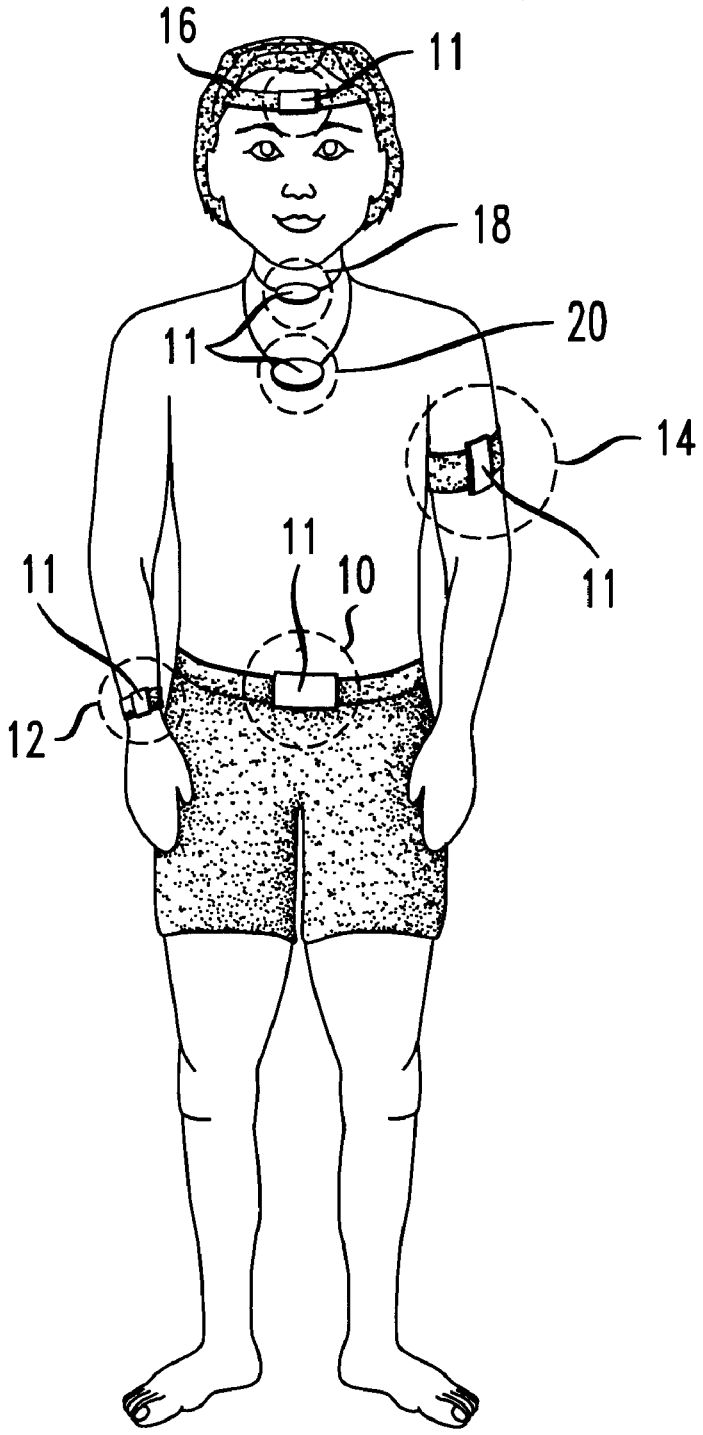
FIG. 1 is an illustration depicting possible different ways in which the water-pressure sensitive dye release swimmer's safety device of the invention may be worn.

In FIG. 1, the various possible locations for the wearing of the dye-pack, life saving device of the invention are indicated at the circled areas, as being incorporated in a swimsuit construction at a belt area 10 (or temporarily clipped or secured there), or as any one of several body accessories coordinated with the swimsuit—for example, a wristband 12, an armband 14, a headband 16, a choker-type necklace 18, or other necklace 20. The device included (shown at 11) need only be of a size to hold a sufficient amount of dye to color a surface area of some 5–10 feet in diameter.

Figure 2:
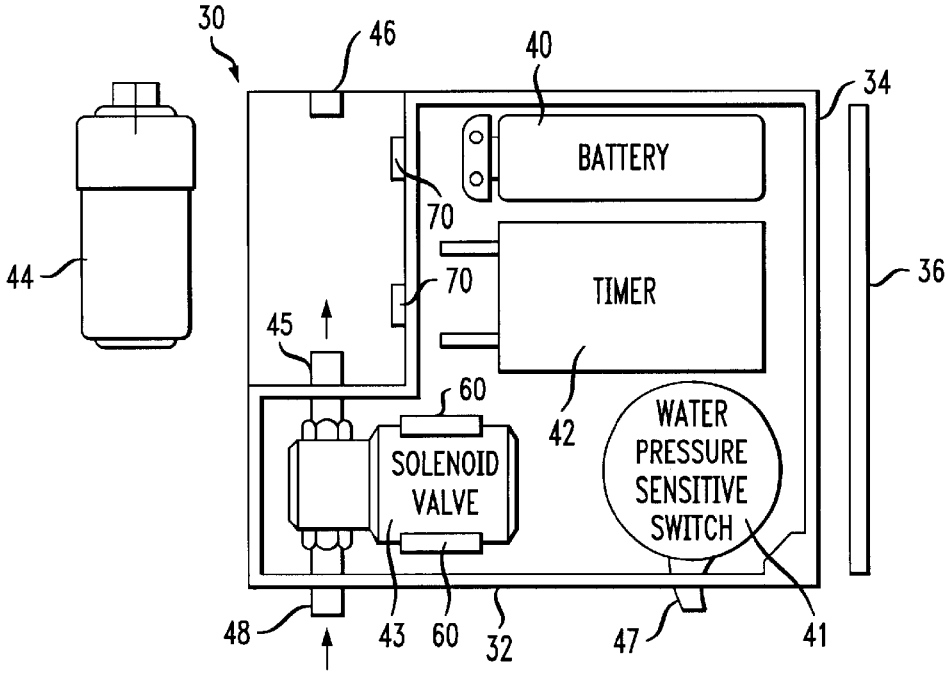
FIG. 2 is a top view of the housing showing the components of the swimmer's safety device with its lid removed.
Figure 3:
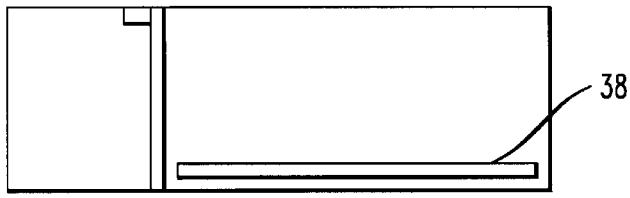
FIG. 3 is a sectional view of the housing showing its circuit board to which the components are electronically coupled.
Figure 4:
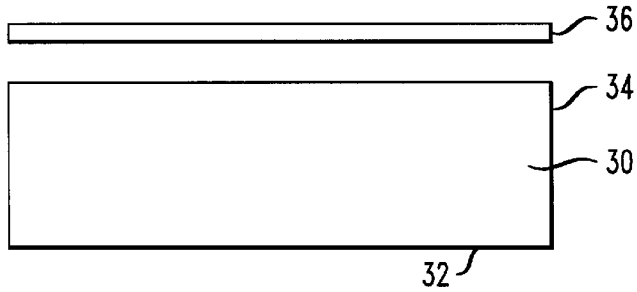
FIG. 4 illustrates the closing of the housing by its lid, ready for use.

In FIGS. 2–4, the cross-sectional view of the housing 30 is shown as having bottom and side surfaces 32, 34 and a removable lid 36. A circuit board 38 is included along the bottom surface 32 and is coupled with a source of battery power 40, a water pressure sensitive switch 41, a timer 42 controlled by the switch 41 and a solenoid valve 43 controlled by the timer 42. Each of the components 40–43 can be held in place within the housing 30 in any appropriate manner, as illustrated by a pair of clips 60 for the solenoid valve 43. Also included is a chamber 44 enclosing a dye material and a water reactive chemical—with the chemical being such as to produce a pressure within the chamber 44 in accordance with its degree of mixing with water. As illustrated, the chamber 44 includes an input port shown at 45 and an output valve shown at 46. As illustrated, the port 45, is coupled with and controlled by the solenoid valve 43, while the output valve 46 releases externally from the housing 30. As further shown, a valve inlet 47 is provided for the pressure sensitive switch 41, while a second valve inlet 48 is arranged to supply water through the port 45 to the chamber 44 once the solenoid valve 43 is opened.

In a preferred embodiment of the invention, a pressure sensitive switch of the P1 series type available from Lamb Industries of Portland, Oregon, may be utilized as the water pressure sensitive switch 41, to close upon its submersion to a depth of some 40 inches. The timer 42 in this embodiment may be of the 6C1 series type available from American Control Products of Westbrook, Connecticut, to run, once initiated, for 30 seconds, to thereafter reset to zero, or to reset to zero in the event its timing run is interrupted. A valve of the AL in-line designation available from Asco/Angar Scientific of Cedar Knolls, N.J. may be employed as the solenoid valve 43.

In operation (as with a source of battery power 40 of 9 volts), until a submerged pressure of 40 inches or more is reached, the timing sequence of the timer 42 is not initiated, the solenoid valve 43 controlled thereby remains open and no water flows from the valve inlet 48 via port 45 to the dye chamber 44. As a result, the output valve 46 remains closed.

In accordance with the invention, on the other hand, when the housing 30 descends to such depth of 40 inches, the water pressure sensitive switch 41 closes through the entry by way of the valve inlet 47, thereby initiating the timing sequence of the timer 42. Indicative of the wearer of the housing 30 descending to such depth, the water pressure sensitive switch 41 opens, however, thereby interrupting the timing sequence, should the wearer then rise above the depth. In the event the wearer continues at or below such depth for the run of the timer 42—30 seconds, for example—, the timer 42 switches the solenoid valve 43 from its quiescently open condition to its closed condition, thereby allowing the flow of water from the valve inlet 48 through the port 45 into the chamber 44 to react with the chemical there. Once such valve 43 is opened, the flow of water into the chamber 44 builds up sufficient pressure via chemical reaction to open the normally closed output valve 46 in releasing the dye into the water surround to provide the visual alarm alert.

On the other hand, and as will be understood, should the timing sequence be interrupted by the wearer rising above the predetermined actuating depth, the solenoid valve 43 opens once more to close off the water flow from the valve inlet 48 to react with the chemical of the dye chamber 44. It is only when the housing 30 is held below the predetermined submerged alert level for the timer 42 to run its sequence will the solenoid valve 43 be closed in permitting the chemical reaction to build up the sufficient pressure to open the ball or other output valve 46 in the release of the dye alarm.

With this understanding, it will be appreciated that different water pressure sensitive switches may be selected in determining the different depths at which the apparatus of the invention is to become operative. Similarly, different selections of the timing sequence may be had in establishing just how long the wearer of the swimmer's safety device is to stay at such submerged level before the solenoid valve becomes active in allowing the pressure build up and the dye release to follow. In such manner, the particular components of the housing may be selected to suit the various needs of whoever is to be wearing the safety device of the invention. Thus, timer selections may be made to initiate the mixing of the chemical reactive ingredient with the inletted water after submersion for 15, 30, 45 or 60 seconds, or longer, and at depths of 30, 35, 40, 45, etc. inches of water, depending upon individual skill level and ability.

In a preferred embodiment of the invention, the cover 36 for the housing is removable to allow access in replacing the battery source 40 when needed—but, more importantly, to allow for snap-in replacement of the dye chamber 44 after use. Such clips as indicated at 70, for example, may be employed to hold the dye chamber 44 in position, centered so that the water through the valve inlet 48 is able to flow unimpeded into the chamber 44 via the port 45. As will be understood, various grommets or other seals (not shown) may be utilized in the production manufacture of the life saving device of the invention in providing optimum flow without undue leakage.

With the invention, then,once the visual alert has been provided, immediate steps can be undertaken to rescue the wearer of the unit. In this respect, the housing 30, in carrying out the invention, can be fabricated of a petroleum-based polyethylene, polypropylene, vinyl, or any other desired material.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

We claim:

1. A swimmer's safety device comprising:

a housing having a removable lid encasing bottom and side surfaces thereof;

a circuit board within said housing;

a source of battery power, a water pressure sensitive switch, a timer controlled by said water pressure sensitive switch, and a solenoid valve controlled by said timer, with each being electronically coupled with said circuit board within said housing;

a chamber within said housing enclosing a dye material and a water reactive chemical coupled to said solenoid valve, with said chamber having an input port and a quiescently closed output valve;

and a valve inlet coupled to said water pressure sensitive switch;

with said water pressure sensitive switch being normally open until said valve inlet is submerged in a body of water beyond a predetermined depth at which said water pressure sensitive switch closes;

with the running of said timer being initiated upon the closing of said water pressure sensitive switch;

with said solenoid valve becoming operable to open said chamber input port to water in response to the running of said timer for a predetermined length of time;

and with said chamber output valve being pressure regulated to open and release the dye material from said housing into said body of water as a visual alarm alert in response to the reaction of said chemical with the water being let into said chamber once said valve inlet is lowered to said predetermined depth and continues at or below said predetermined depth for said predetermined length of time.

2. The swimmer's safety device of claim 1 wherein said running of said timer is interrupted upon subsequent rising of said valve inlet above said predetermined depth.

3. The swimmer's safety device of claim 2 wherein said timer is automatically reset to its initial condition upon the subsequent rising of said valve inlet above said predetermined depth.

4. The swimmer's safety device of claim 3 wherein said solenoid valve is operable to open said chamber input port to water in response to the running of said timer for 30 seconds.

5. The swimmer's safety device of claim 4 wherein said water pressure sensitive switch is normally open until said valve inlet is submerged in a body of water to a depth of 40 inches.

6. The swimmer's safety device of claim 3 wherein said chamber output valve includes a ball valve operable to open upon a predetermined pressure build up within said chamber due to the reaction between the water being let in and the water reactive chemical thereof.

7. The swimmer's safety device of claim 3 wherein said chamber is a snap-in replaceable unit within said housing.

8. The swimmer's safety device of claim 1 wherein said housing is secured with a swimsuit constriction by one of an incorporation therewith or a clipping thereto.

9. The swimmer's safety device of claim 1 wherein said housing is worn by a swimmer as one of a wristband, armband, necklace or headband.

* * * * *